US006370354B1

(12) United States Patent
Chapman et al.

(10) Patent No.: US 6,370,354 B1
(45) Date of Patent: Apr. 9, 2002

(54) METHOD AND APPARATUS FOR CONTROLLING MEDIA-TO-IMAGE REGISTRATION OF A SINGLE-PASS INTERMEDIATE TRANSFER MEMBER-BASED PRINTING APPARATUS

(75) Inventors: Danny Keith Chapman, Nicholasville; Matthew Lowell McKay, Lexington, both of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/635,484

(22) Filed: Aug. 8, 2000

(51) Int. Cl.[7] ..... G03G 15/00

(52) U.S. Cl. ..... 399/394; 399/396

(58) Field of Search ..... 271/264, 265.01, 271/265.02, 266, 270; 399/66, 75, 76, 78, 381, 388, 394, 396

(56) References Cited

U.S. PATENT DOCUMENTS

| | | | |
|---|---|---|---|
| 3,700,324 | A | 10/1972 | Hutner et al. |
| 4,350,750 | A | 9/1982 | Suzuki et al. |
| 4,421,402 | A | 12/1983 | Komori et al. |
| 4,456,369 | A | 6/1984 | Sato |
| 4,660,964 | A | 4/1987 | Yoshikawa et al. |
| 4,989,020 | A | 1/1991 | Namba |
| 5,155,541 | A | 10/1992 | Loce et al. |
| 5,255,062 | A | 10/1993 | Oka et al. |
| 5,274,428 | A | 12/1993 | Wong et al. |
| 5,317,347 | A | 5/1994 | Masuda et al. |
| 5,367,327 | A | 11/1994 | Harris |
| 5,373,354 | A | 12/1994 | Tadokoro et al. |
| 5,381,167 | A | 1/1995 | Fujii et al. |
| 5,442,429 | A | 8/1995 | Bartholmae et al. |
| 5,452,073 | A | 9/1995 | Kataoka |
| 5,455,668 | A | 10/1995 | DeBock et al. |
| 5,481,345 | A | 1/1996 | Ishida et al. |
| 5,499,093 | A | 3/1996 | Aerens et al. |
| 5,526,108 | A | 6/1996 | Billet et al. |
| 5,557,377 | A | 9/1996 | Loewen et al. |

(List continued on next page.)

*Primary Examiner*—Arthur T. Grimley
*Assistant Examiner*—Hoang Ngo
(74) *Attorney, Agent, or Firm*—John V. Pezdek; Michael T. Sanderson; Frederick H. Gribbell

(57) ABSTRACT

An improved printing apparatus provides for very accurate synchronization between cut sheet print media and the unfixed image which is conveyed on an Intermediate Transfer Member (ITM) such as a belt or a drum, and which is targeted for said print media. The printing apparatus is constructed as a single-pass ITM-based electrophotographic (e.g., laser) printer, and the length of the input print media pathway prior to image-to-media transfer is significantly shorter than the sum of the lengths of the image travel along a photoconductive drum and ITM. The print media is typically launched after imaging has been initiated on the photoconductive drum by an imaging apparatus. Variance in the leading edge of the print media with respect to the leading edge of image can be introduced due to phenomena such as pick errors, velocity variation, and uncertainties in the paper stack height. The present invention minimizes this leading edge variance to a tightly targeted specification by accurately sensing the positions of the print media and the ITM image, and correcting the print media's position by controlling the velocity of the print media prior to arriving at the transfer nip. In addition, the present invention detects the presence of print media within the sheet feeder cassette tray before imaging is started in the ITM belt, thereby minimizing the amount of waste toner generated by the printing apparatus. The imaging procedure on the ITM belt typically begins at a time prior to the printer controller having precise knowledge as to the location of the "next" sheet of print media within the combination of the input print media pathway and sheet feeder cassette tray.

14 Claims, 11 Drawing Sheets

U.S. PATENT DOCUMENTS 5,583,623 A 12/1996 Bartholmae et al.
5,587,783 A 12/1996 Nakamura et al.
5,623,719 A 4/1997 De Cock et al.
5,652,948 A 7/1997 Sakaguchi et al.
5,671,475 A 9/1997 De Cock et al.
5,697,015 A 12/1997 Ream et al.
5,697,031 A 12/1997 Kamiya et al.
5,740,493 A 4/1998 Otaki et al.
5,758,237 A 5/1998 Abramsohn
5,758,244 A 5/1998 Iwakura
5,768,671 A 6/1998 Komiya et al.
5,799,225 A 8/1998 Abe et al.
5,805,967 A 9/1998 De Bock et al.
5,815,779 A 9/1998 Abramsohn
5,821,969 A 10/1998 Koshi et al.
5,828,937 A 10/1998 Aerens et al.
5,848,337 A 12/1998 Liu et al.
5,875,380 A 2/1999 Iwata et al.
5,893,018 A 4/1999 De Bock et al.
5,907,344 A 5/1999 Tanimoto et al.
5,909,235 A 6/1999 Folkins
5,933,689 A 8/1999 Kim
5,978,561 A 11/1999 Kimura et al.
6,002,904 A 12/1999 Yoshida et al.
6,026,256 A 2/2000 Abe et al.
6,014,542 A1 * 1/2001 Hozumi et al. ..... 399/394

* cited by examiner

TIMING DIAGRAM FOR A TYPICAL EARLY 2ND SHEET

TIMING DIAGRAM FOR A TYPICAL LATE 2ND SHEET

METHOD AND APPARATUS FOR CONTROLLING MEDIA-TO-IMAGE REGISTRATION OF A SINGLE-PASS INTERMEDIATE TRANSFER MEMBER-BASED PRINTING APPARATUS

TECHNICAL FIELD

The present invention relates generally to image forming equipment and is particularly directed to a printing apparatus of the type which includes a single-pass intermediate transfer member, with multiple print engines. The invention is specifically disclosed as a printer that controls the print media-to-image registration where the unfixed image resides on a single-pass intermediate transfer member, and additionally reduces waste toner by detecting a sheet of print media in the input media source before imaging is started for that particular sheet.

BACKGROUND OF THE INVENTION

The field of electrophotographic (EP) printers, particularly those intended for the office environment, is actively migrating from monochromatic (black) printers to color printers. This migration is being driven in part by the advent of systems that can deliver color prints at the same speed as black-only prints. Most conventional color EP printing machines can only produce color output at some percentage of the total output achievable for black (monochrome) output. This is dictated by conventional processes whereby a revolving member transfers a single color plane at a time to a receiving member.

Hence, for a typical color EP machine, the output printing rate for color print-outs is roughly cut by a factor of four. This type of architecture yields extremely lengthy time between prints, or extremely long interpage gaps between prints. Not only does the increase in interpage gap produce undesirable and excessive cycling of EP components, the increase in process times required to produce color copy at a rate deemed acceptable by the market with respect to black copy can significantly impact the machine size and cost.

Much recent activity within the prior art has concentrated on developing printer architectures that can layer the four color planes (cyan, magenta, yellow, and black) required for color imaging in a single pass, such that no penalty is paid for transferring individual color planes one at a time. Such single-pass printers layer the four colors either to an intermediate transfer member (ITM), or directly to the print media in a manner similar to more traditional EP printing devices.

One such architecture calls for print media to pass directly underneath four independent photoconductive drums arranged in tandem, whereby at each station a different color plane is laid on top of the foregoing plane. In this architecture, the leading edge of the print media is typically sensed just prior to the first imaging and toner development station at a sufficiently large distance that careful design and control of the timing and print media velocity, from the sense point to the transfer point, will lead to proper registration of the image with respect to the print media.

Another conventional printer design uses "staging," or "gating," as a technique for aligning the print media with the image. This technique is not limited to color EP processes; the IBM 4028 monochrome laser printer utilizes a similar technique for reducing the time-to-first-print, and for marginally improving throughput. Basically, a sheet is conveyed and stopped at a known location at a known time, and then released at just the appropriate moment and accelerated to the correct velocity such that alignment with an image can occur accurately at a transfer station.

In an EP color printer having a single-pass or pipeline architecture, including an ITM belt or drum, the four color planes are layered first onto the intermediate member before the aggregate image is transferred to the print media at a secondary transfer point. In this arrangement, conveyance of the print media must be coordinated with image generation in a much more controlled fashion, especially for printing machines developed for the office environment where machine size is an important factor, which dictates that paper path lengths be minimized. This extra attention to print media registration and image placement is warranted due to the fact that the ITM circumferential travel distance can easily be two or three times the length of the typical input print media pathway, between the media picking point and the transfer nip (transfer point).

In order to image with a minimal yet known interpage gap between prints, the imaging process may have to be initiated well before the targeted sheet for that image is launched from the sheet feeder tray. Moreover, further complications are added to the printing system if optional sheet feeding units are added underneath the printer, such that the input print media pathway becomes longer than the image path. In this situation, sheet launching may have to take place prior to imaging depending on the geometry of the feeder. Whatever control mechanism that is put in place must be able to accommodate either pick-to-image scenario. These constraints pose a number of problems from a system control perspective.

One problem can be anticipated by considering that most sheet feeders introduce some amount of error in the location of the sheet at the time of the pick, due to print media slippage or velocity variation. Furthermore, if the sheet feeder incorporates a pick mechanism that tracks with the top of a varying print media stack height, the total distance the paper has to travel from its rest position to the transfer point (transfer nip) varies, sometimes unpredictably, as a function of the amount of print media within the tray. Other errors that introduce print media positional uncertainty result from velocity variation, print media slippage or deviation away from the nominal print media trajectory within the designed channel (e.g., an input print media pathway) where the print media is conveyed between the sheet feeder tray and the transfer nip. If all these error sources or uncertainties are present within a printing machine that embodies the ITM architecture, it can easily be understood that some method of controlling or eliminating these variances must be developed in order to properly register the top writing line of the print media with the image, assuming the location of the leading edge of the image is known within a good degree of certainty.

Another problem that arises as a result of developing an image onto the ITM before the print media is launched from the sheet feeder tray is in regard to waste management. Certainly it is to be expected that, with the ITM architecture, toner will need to be cleaned off of the transfer medium surface in the event of a feeding failure or jam, since the print media will not be present to receive the image. Failure to clean the ITM surface would otherwise result in contamination of future print jobs or other mechanical components within the machine. Fortunately, the art has progressed to the state that such occurrences can be minimized to the point of rarity.

However, with an ITM single-pass architecture, additional toner waste can be generated if a media-out condition is not detected prior to imaging, and toner accumulation being initiated on the ITM. If the media-out condition is not considered as a design criterion, the potential for this occurrence is certainly good given the difference in length of the ITM surface travel with respect to the input print media pathway length. For instance, it is conceivable that development of the second image of a multi-sheet print job could be well under way on the ITM by the time the first sheet in the sheet feeder tray has progressed far enough to allow detection of the availability of a second sheet in the tray (to receive the "second" image already being developed on the ITM). If and when this condition occurs, waste toner would have to be sent to a volumetrically limited waste container.

Other waste management means potentially might lessen this impact to the ITM waste container. For instance, a sheet from an alternate auxiliary source might be launched on command from the controller with the express purpose of receiving the waste image, or the transfer bias voltages on the cartridge photoconductive drums might be reversed in order to back transfer the waste image and send it to the cartridge cleaner reservoir.

Less obvious is the fact that the registration problem and the waste management problem are coupled. If the design constraint to positively detect the presence of print media in the designated sheet feeder tray prior to imaging and toner accumulation is incorporated in the printer (due to a need to minimize waste), then the nature of the positional error correcting implementation must also operate under that same constraint.

SUMMARY OF THE INVENTION

Accordingly, it is a primary advantage of the present invention to provide an image forming apparatus that controls positional error in its output printing device, by applying an image onto an intermediate transfer member development using one or more print engines, while controlling the intermediate transfer member at a substantially predetermined velocity, which may be a constant velocity; and by controlling a variable velocity of a sheet of print media as that sheet travels through an input print media pathway so as to cause a leading edge of the sheet to arrive at the transfer nip at substantially the same moment as a leading edge of the image traveling on the intermediate transfer member, thereby substantially eliminating registration error.

It is another advantage of the present invention to provide an image forming apparatus that reduces waste toner by, prior to imaging at any of a plurality of print engines and prior to initiating a picking operation at an input print media source, determining whether or not at least one sheet of print media currently exists within the input print media source, and if not, preventing imaging.

It is a further advantage of the present invention to provide an image forming apparatus that corrects or minimizes the positional errors, as discussed above, without violating the need to prevent any waste toner from being generated as a result of a common media-out condition.

Additional advantages and other novel features of the invention will be set forth in part in the description that follows and in part will become apparent to those skilled in the art upon examination of the following or may be learned with the practice of the invention.

To achieve the foregoing and other advantages, and in accordance with one aspect of the present invention, a method for controlling positional error in an image forming system is provided, in which the method comprises: providing an image forming apparatus having a memory circuit for storage of data, and a processing circuit for controlling at least one physical device; providing at least one print engine, an intermediate transfer member, and an input print media pathway, wherein the intermediate transfer member and input print media pathway physically pass through a transfer nip; applying an image onto the intermediate transfer member by way of the one or more print engines, while controlling the intermediate transfer member at a substantially predetermined (perhaps constant) velocity; and controlling a variable velocity of a sheet of print media as that sheet travels through the input print media pathway, without halting movement of the sheet, so as to cause a leading edge of the sheet to arrive at the transfer nip at substantially the same moment as a leading edge of the image traveling on the intermediate transfer member, thereby substantially eliminating registration error.

In accordance with another aspect of the present invention, a method for reducing waste toner within an image forming system is provided, in which the method comprises: providing an image forming apparatus having a memory circuit for storage of data, and a processing circuit for controlling at least one physical device; providing a plurality of print engines and a single-pass intermediate transfer member; providing an input print media source, and an input print media pathway; and prior to imaging at any of the plurality of print engines and prior to initiating a picking operation at the input print media source, determining whether or not at least one sheet of print media currently exists within the input print media source, and if not, preventing imaging to reduce toner wastage.

In accordance with a further aspect of the present invention, an image forming apparatus is provided, comprising: a memory circuit for storage of data, and a processing circuit for controlling at least one physical device, at least one print engine, an intermediate transfer member, and an input print media pathway, wherein the intermediate transfer member and the input print media pathway physically pass through a transfer nip; wherein the processing circuit is configured to use the at least one print engine to apply an image onto the intermediate transfer member, while controlling the intermediate transfer member at a substantially predetermined (perhaps constant) velocity; and to control a variable velocity of a sheet of print media as that sheet travels through the input print media pathway, without halting movement of the sheet, so as to cause a leading edge of the sheet to arrive at the transfer nip at substantially the same moment as a leading edge of the image traveling on the intermediate transfer member, thereby substantially eliminating registration error.

Still other advantages of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views.

The present invention provides for very accurate synchronization between cut sheet print media such as plain paper, card stock, or transparencies, and the unfixed image which is conveyed on an Intermediate Transfer Member (ITM) such as a belt or a drum, and which is targeted for said print media. In a single-pass ITM-based EP printing apparatus, the length of the input print media pathway prior to image-to-media transfer can be significantly shorter than the sum of the lengths of the image travel along a photoconductive drum and ITM. In this type of printer, it may be advantageous for the print media to be launched after imaging has been initiated on the photoconductive drum by an imaging apparatus. However, variance in the leading edge of the print media (i.e., its positional error within the input print media pathway) with respect to the leading edge of image (i.e., the image being developed on the ITM) can be introduced due to phenomena such as pick errors, velocity variation, and uncertainties in the paper stack height. The present invention minimizes this leading edge variance to a tightly targeted specification by accurately sensing the positions of the print media and the ITM image, and correcting the print media's position by controlling the velocity of the print media prior to arriving at the transfer nip.

Since the print media may be launched after imaging has begun and after toner has started accumulating on the ITM, control of this variable speed registration process is coordinated with strategic placement of a sensor that tracks the presence of print media within the sheet feeder cassette tray in order to minimize the amount of waste toner generated by the printing apparatus. In short, the methodology of the present invention provides a technique for measuring and correcting the positional error in a launched sheet of print media with respect to an image that is constructed on the ITM—either before or after the "launched" sheet has been picked—and coordinates the imaging/sheet feeding relationship, while minimizing the amount of waste toner generated due to a peculiarity of an ITM printing configuration with respect to print media presence sensing. In fact, the imaging procedure on the ITM can begin at a time prior to the printer controller having precise knowledge as to the location of the "next" sheet of print media within the combination of the input print media pathway and sheet feeder cassette tray.

Figure 1:
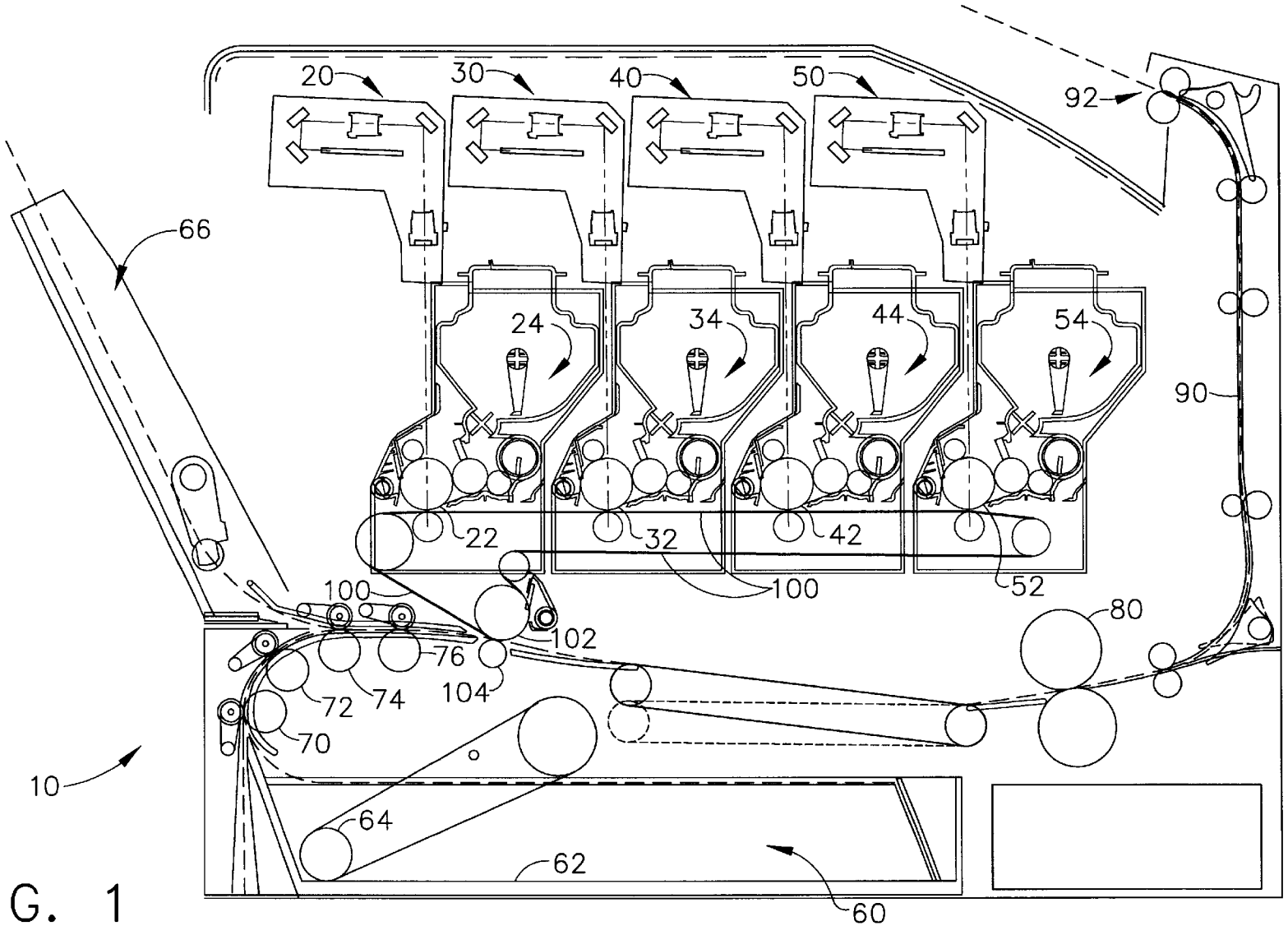
FIG. 1 is an elevational view in cross-section from the front of a preferred printing apparatus that utilizes a plurality of print engines that are in tandem and used with a single-pass intermediate transfer member (ITM), as according to the present invention.

FIG. 1 illustrates a single-pass "ITM" (Intermediate Transfer Member) printing apparatus, generally designated by the reference numeral 10, which has multiple color capability. The printing apparatus 10 includes four independent imaging sources, four individual toner supply cartridges, an ITM belt in contact with each of four photoconductive drums, which form a primary transfer nip at each color station, and a secondary transfer nip between the ITM mechanism and a secondary charge transfer roller. Furthermore, a sheet feeding conveyance system which encompasses a plurality of jointly driven edge aligner rolls is included, as well as a sheet feeding cassette tray and a pick mechanism that has a set of drive rolls that passively track the top of the paper stack in the cassette tray, and which are energized by an independent drive source. At least one paper sensor is included to detect the leading edge of the print media (sheet media) as it progresses through the paper path or channel.

As illustrated in FIG. 1, printing apparatus 10 is a four-color device, which includes four laser printheads at 20, 30, 40, and 50 on FIG. 1. Each of these laser printheads is assigned to an individual toner supply cartridge (which is also sometimes referred to as a "process cartridge," as it can contain other printhead components as well), designated at reference numerals 24, 34, 44, and 54. Furthermore, each of the process cartridges includes its own individual photoconductive drum, as noted above, and designated at reference numerals 22, 32, 42, and 52.

In FIG. 1, the printing apparatus is illustrated as being viewed from its front in a cross-sectional view, such that a sheet feeder tray, generally designated by the reference numeral 60, is located at its bottom-most portions. Sheet feeder tray 60 also is commonly referred to as a "paper tray," or an "input paper tray," and includes a pick mechanism that includes an independent drive source for its primary drive rollers, including a drive roller at 64. The print media, also referred to as sheet media or paper, is indicated at the reference numeral 62.

When a sheet of print media is picked at the sheet feeder tray 60, the picking mechanism 64 causes that sheet of media to be pushed forward (i.e., to the left on FIG. 1), which forces the sheet of media to be forced against an angled wall, and then upward. Pairs of drive rollers are then used to engage the sheet of media through the input paper path, and these drive rollers are generally designated by the reference numeral 70, 72, 74, and 76. Each of these drive rollers 70–76 includes a physically driven roller and a corresponding idler, in which each of these roller pairs forms a nip through which the sheet media must pass. An alternative input path is available for printer 10, using an auxiliary sheet feeder at 66.

Ultimately the sheet media arrives at a transfer nip where the toner is applied to the sheet media. This transfer nip is designated by the reference numeral 106 (see FIG. 2), and is formed by two rollers 104 and 102. As the sheet media passes through the transfer nip 106, it continues to a fuser at 80, and further continues through an output paper path at 90, exiting the internal portions of the printer at an output nip at 92.

The intermediate transfer member of the printing mechanism 10 is a flexible belt that is sensitive to electrical charge and consists of generally resistive material. This belt is generally designated by the reference numeral 100, and in FIG. 1 extends in a horizontal plane through each of the primary transfer nips at each color station, which essentially occurs at each of the photoconductive drums 22, 32, 42, and 52. Transfer belt 100 will generally be referred to herein as the "ITM belt," which wraps around a roller at 108 (see FIG. 2), and is then re-directed toward the transfer nip 106 (see FIG. 2) where it wraps around another roller at 102. This roller 102 forms half of the transfer nip 106. ITM belt 100 then continues past another roller and then runs mainly horizontally before it wraps around a further roller to then pass through the primary transfer nips of each color station.

Figure 2:
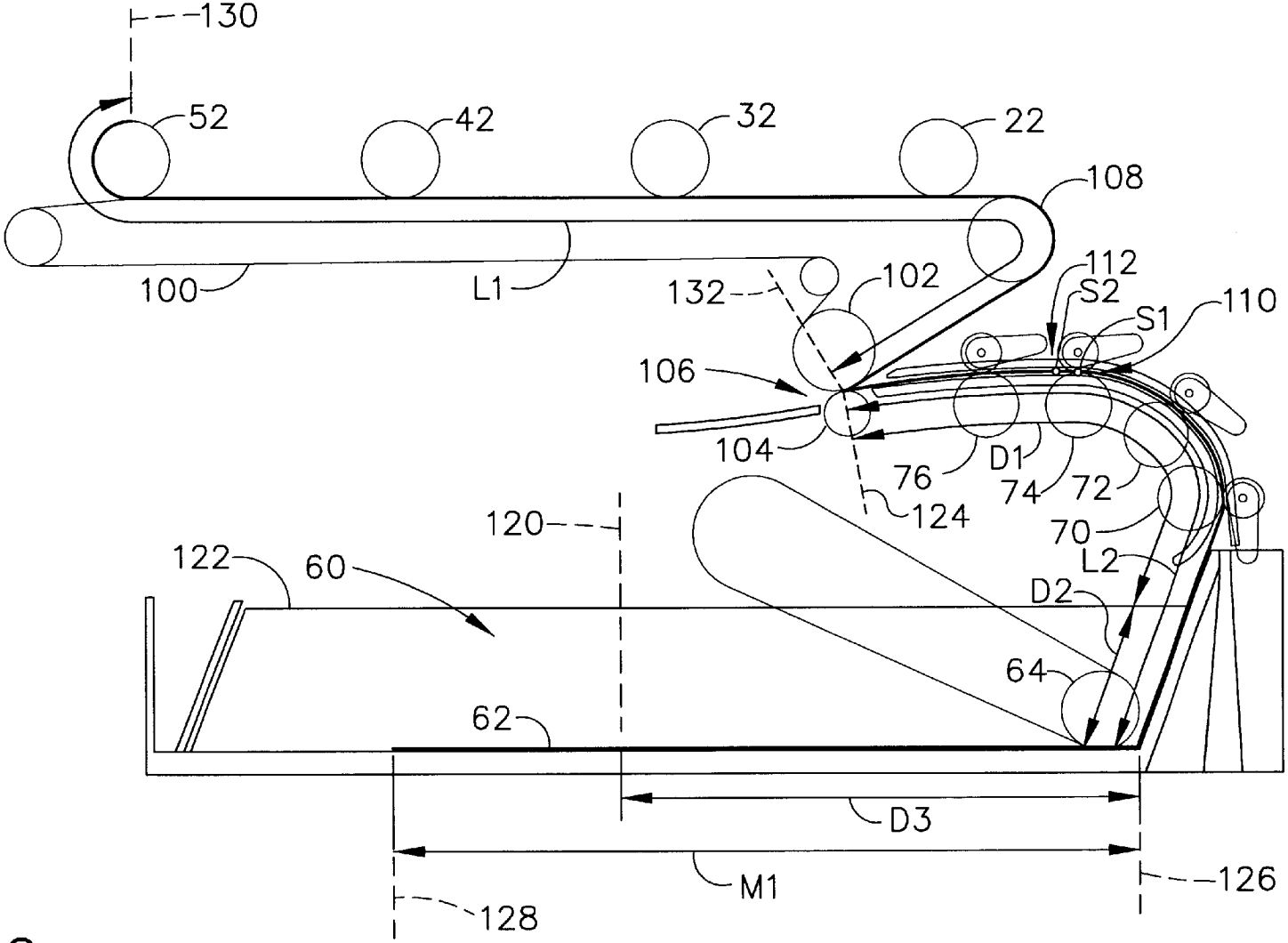
FIG. 2 is an elevational view in cross-section from the rear of the printer of FIG. 1, showing some of the major components of the paper path—extending from the input tray through the input rollers, and image pathway along the ITM belt, and associated multiple photoconductive drums.

Referring now to FIG. 2, the ITM belt 100 and the input paper path are illustrated, and this view is now from the rear of a preferred single-pass ITM-based printing apparatus 100. In a preferred mode of the present invention, the ITM belt 100 will be driven during imaging so that it moves at a predetermined, and substantially constant, velocity for a particular print resolution. For a preferred color printer manufactured by Lexmark International, Inc., if the print resolution is 600 dpi (dots per inch), the nominal velocity of the ITM belt 100 is 110 mm/sec. For a print resolution of 1200 dpi, the nominal velocity is 55 mm/sec.

The drive rollers in the input paper path (i.e., drive roller pairs 70, 72, 74, and 76) are also capable of moving a sheet of print media at a variable velocity. The range of velocity here is quite significant, and in a preferred mode of the present invention, the drive rollers can move a sheet media in the range from 25 mm/sec through 220 mm/sec. This provides a tolerance for variable speed capability for a particular nominal velocity at a pre-determined print resolution of +100%/−50% capability. This large control range of velocity in the input paper path is desirable, since the positional error (or registration error) that will be corrected by the present invention can be significant, especially when the input paper tray is replaced by a stack feeder that can contain several hundred sheets of print media. The present invention can be used to correct positional error that is even greater than +/−one inch (25 mm).

Two paper sensors designated "S1" and "S2" are utilized in the printing mechanism 10 to detect the actual location of a sheet of print media while it is in motion in the input paper path. The sensors S1 and S2 are located, respectively, at the positions indicated by the reference numerals 110 and 112 on FIG. 2. It will be understood that "paper" sensors S1 and S2 are capable of detecting all forms of print media, including plastic media and clear transparency media; moreover, the sensors S1 and S2 can be one of several different types of sensing devices, including sensors that are either "contact" devices or "non-contact" devices.

Sensors S1 and S2 are used to detect the leading edge of the print media, although in some configurations, the sensor S1 may not be located along the paper channel so as to detect "narrow" print media, such as envelopes. Of course, sensor S1 alternatively could be placed in a position where it would always detect any size media that the sensor S2 would detect. In one configuration of the present invention, if sensor S1 will not detect a relatively narrow print media, then sensor S2 will be the only one of these two sensors to detect the leading edge of the print media.

For most sizes of print media sheets, once the print media arrives at sensor S1, the printer's controller compares the remaining amount of travel to the transfer nip 106 of the print media with the known remaining travel to transfer nip 106 of an image located on the ITM belt 100. Any resultant value other than zero (0) is the positional error of the print media relative to the image position. Since the ITM belt 100 always travels at a predetermined constant velocity for a particular print resolution, then it is the velocity of the print media in the input paper path that must be corrected to arrive at the correct time at the transfer nip 106.

When the leading edge of the print media reaches the sensor S2, the printer controller will determine the correct velocity at which the input media should be driven to reach the transfer nip at the correct time. In the configuration illustrated on FIG. 2, the sensor S2 is the final feedback information before the printer controller begins operating in an essentially open loop control mode. Of course, additional paper-sensing devices could be utilized besides the two sensors S1 and S2 that are illustrated on FIG. 2, or the sensor S2 itself could be moved to a position that is further upstream or downstream in the input paper path so as to be positioned at a greater or lesser distance from the transfer nip 106, without departing from the principles of the present invention.

It is preferred that the printer's controller make corrections to the input media velocity based upon the information received when the media arrives at both S1 and S2. Of course, if the media is "narrow" and will not be detected by the sensor S1, then the printer's controller must make its decisions based upon only the information gleaned from the leading edge of the print media arriving at the sensor S2. Assuming that the print media is sufficiently wide to be detected by S1, then the printer controller will make its first correction of the input sheet's velocity when the leading edge reaches S1, and will then make a further correction when the leading edge reaches the sensor S2. Of course, once the velocity has been controlled upon reaching sensor S1, it may not be required to change that previously determined velocity when the leading edge reaches sensor S2. The details of making these decisions are provided in a discussion hereinbelow in reference to flow charts of FIGS. 7 and 8.

A more complete discussion of the control methodology that can be implemented for error correction based upon feedback from imaging system motors and variable speed media drive motors is found in a pending U.S. application, filed on Apri. 6, 2000, under the Ser. No. 09/545,202, entitled Method and Apparatus for Positioning Paper in an Imaging System having an Intermediate Transfer Medium, which is commonly assigned to Lexmark International, Inc., and which is incorporated by reference herein in its entirety.

In the preferred mode of the present invention, the distance between the transfer nip 106 and the sensor S1 is 85 mm, and the distance between transfer nip 106 and the sensor S2 is 77 mm. This distance between the location of sensor S2 at 112 and the transfer nip 106 will be referred to hereinbelow as a distance "G2," which preferably is equal to the circumference of the fourth drive roller at 76.

With reference to this fourth drive roller 76, a signal designated "R4" is generated that represents when the trailing edge of the sheet of print media leaves the nip formed at the fourth drive roller 76. The use of this signal R4 is described hereinbelow, but it is important to note that the velocity at which the drive rollers 70, 72, 74, and 76 attempt to transport the sheet of print media must closely match the velocity at which the ITM belt 100 is being driven during certain portions of the travel of the sheet of print media throughout the printer 10. The critical moment begins when the leading edge of the sheet of print media arrives at the transfer nip 106, and the velocity matching control mode continues until the trailing edge of the sheet of print media passes through the final drive roller nip at 76.

Thus the signal R4 signifies the moment that the drive rollers 70–76 can be driven at a different velocity for the next sheet of print media that is going to be sourced from the sheet feeder tray 60 (or from some other media input source). In the preferred mode of the present invention, an individual sensor is not located at the nip of the fourth drive roller, and therefore, the signal R4 must be inferred from other information. In this preferred mode of the present invention, R4 is generated based upon encoder counts after the trailing edge of the sheet media leaves the sensor S2. This essentially takes into account the distance G2, and the speed or velocity of the print media as it is being driven by the drive rollers 70–76, since the preferred drive motor mechanism is a DC motor which uses an encoder as part of its control mechanism.

By using the present invention, it is preferred that the existence of a sheet of print media in the sheet feeder tray 60 be detected before allowing an image to begin forming on the ITM belt 100. Unfortunately, conventional printing systems do not test for the existence of print media in the feeder tray, and consequently, will allow an image to begin forming on an ITM device even though waste toner may have to be cleaned from the ITM device and photoconductor surface. These conventional systems are, therefore, inefficient and this is an undesirable aspect of the previously known systems. On FIG. 2, the circumferential travel distance that the image on the ITM belt must take along the last photoconductor drum 52 and along the ITM belt 100, is labeled as "L1." This distance extends from a line 132 that intersects the transfer nip to a line 130 that goes through the centerline of the photoconductive drum 52. The line 130 at the one end of L1 represents the image point for the last color plane that is being imaged on printer 10.

The print media travel length from the pick point in the paper tray 60 is labeled as "L2," which comprises the distance components "D1" and "D2," which respectively represent the nominal media path distance and the variable paper stack height distance factor. The top of the paper stack is designated at the location 122, and the distance D2 runs from the bottom of the paper stack to the top of the paper stack, while the distance D1 runs from the top of the paper stack (at 122) to a line 124 that intersects the transfer nip at 106.

A "print media present" sensor (not shown) preferably is located a distance "D3 " from the leading edge of the print media that is at rest in the bottom of the sheet feeder tray 60. As seen on FIG. 2, the distance D3 runs from a line 120 (which is at the location of the media present sensor), to the leading edge of the print media that remains in the bottom of the paper tray (which is at a line 126). In this example of FIG. 2, the length of the print media within the tray is given as the distance "M1," which runs from the line 126 to a line 128 that represents the distal end of a sheet of print media on the bottom of the paper tray, i.e., a sheet of print media 62.

Figure 3:
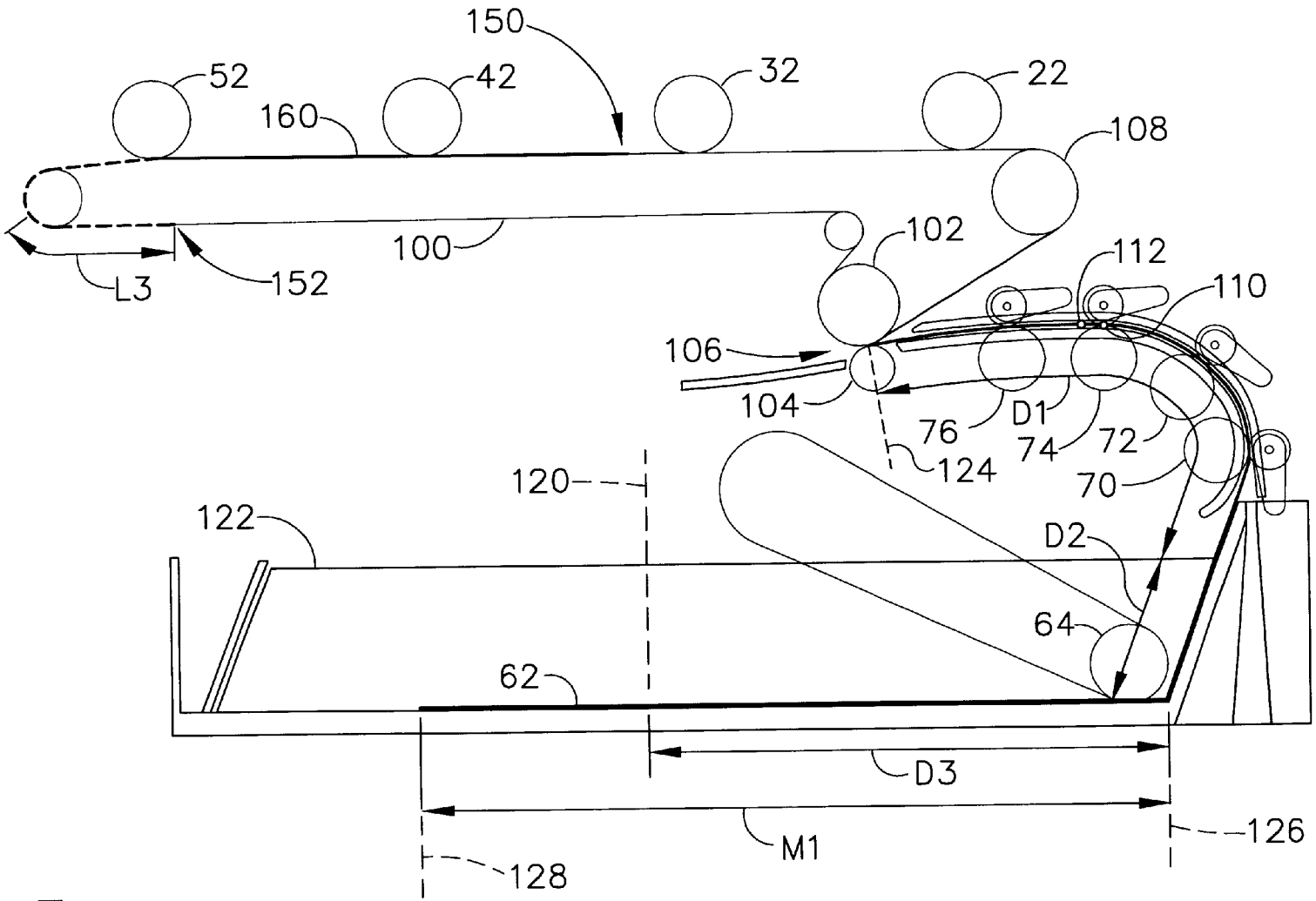
FIG. 3 is a cross-section elevational view of the printer as depicted in FIG. 2, showing a first image being applied to the ITM belt.

A sheet of print media is launched from the sheet feeder tray 60 at a time "T0" after imaging has begun on the photoconductive drum furthest away from the transfer nip (i.e., photoconductive drum 52 on FIG. 2). The sheet is then conveyed at a nominal velocity along the desired media path, as described above. The time T0 controlling the picking operation of the sheet of print media is a function of the difference in path lengths for the image travel (i.e., length L1) and the media travel (i.e., length L2), and this function can be referred to as f(L1–L2). FIG. 3 illustrates the relative location of the image on the ITM belt 100 and the print media in the tray at time T0.

The portion of the image that is yet to be transferred is portrayed as a dashed line on the upstream side of the ITM belt 100, and this dashed line runs from a point designated at 152 to the primary transfer nip at the photoconductive drum 52. The portion of the image that already has been transferred to the ITM belt is designated at the reference numeral 160, and its leading edge is designated at the point 150. The path length that the image travels while on the photoconductive drum is also graphically unwrapped onto the representation for the ITM belt, and is roughly equal to a length designated as "L3." Nominally, the remaining image travel at this time is equal to D1+D2.

Figure 4:
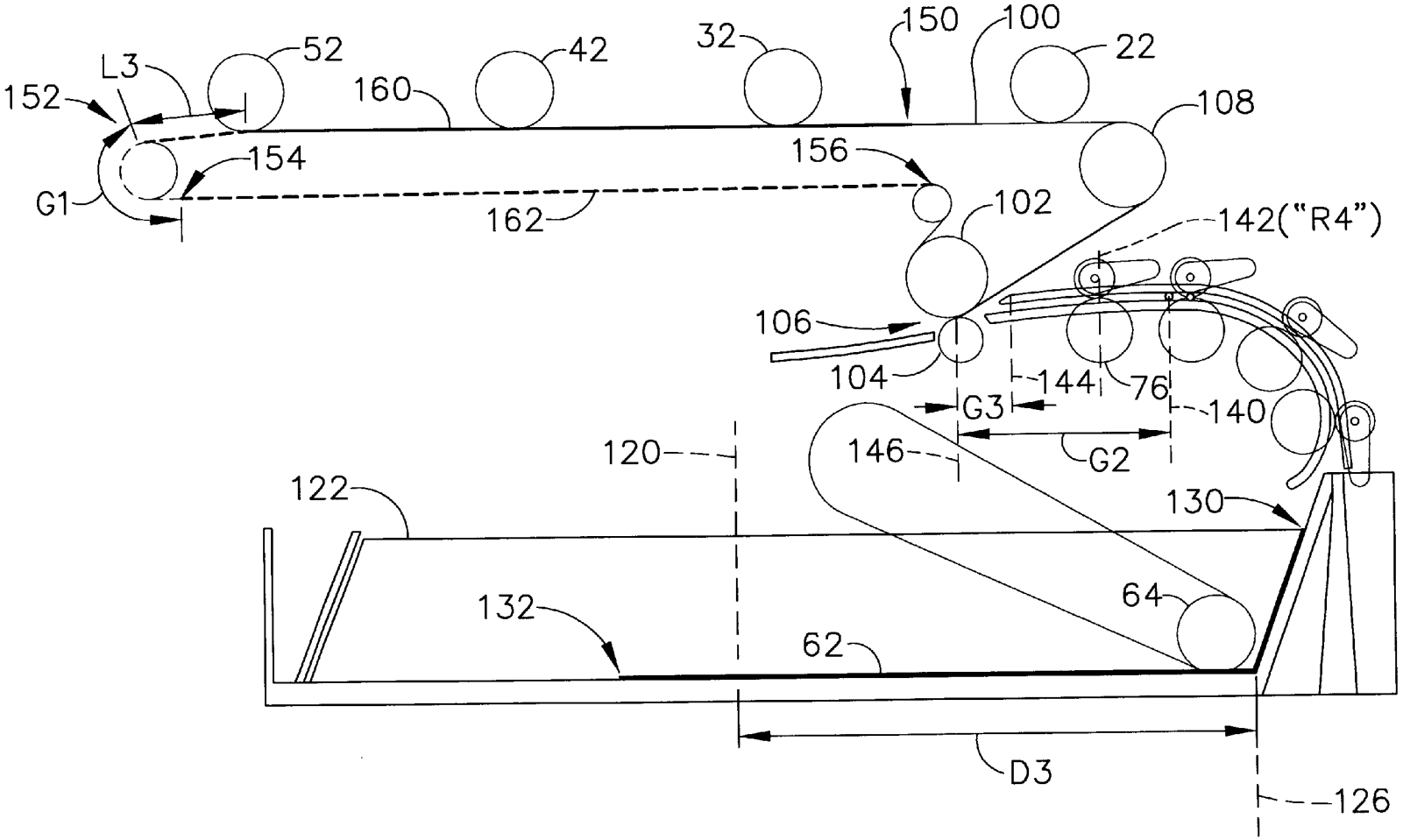
FIG. 4 is a cross-section elevational view of the printer depicted in FIG. 2, showing a sheet media picking operation and a prospective placement of the second image on the ITM belt.

When the trailing edge of the first image has just completed being scanned onto the photoconductive drum furthest from the transfer nip (i.e., photoconductive drum 52), this is referred to as a time "T1." A substantial portion of the targeted sheet media still remains in the sheet media tray 60 at this moment, and the leading edge of the sheet media is some distance away from the transfer nip, as illustrated in FIG. 4. In this position, the particular sheet of print media is still designated by the reference numeral 62, and its leading edge is located at 130, while its trailing edge is located at 132.

FIG. 4 also illustrates the nominal "interpage gap," G1, between the first and second image that will be rendered on the ITM belt 100. This interpage gap G1 is determined by the printer controller, and is assumed to be constant for purposes of discussing the present invention. On FIG. 4, the interpage gap is illustrated as running from a point at 152 that represents the trailing edge of the first image (which is not totally rendered as of yet), then to a point at 154 that represents the leading edge of the next image that will be rendered. This second image is represented by a dashed line 162, and has a trailing edge that is designated at 156. On FIG. 4, the first image has moved to a point where its leading edge 150 is now between the nearest photoconductive drum 22 and the second nearest photoconductive drum 32. As noted above, the second image is depicted as a dashed line on the upstream side of the ITM belt 100, and is illustrative of an image yet to be physically transferred onto the belt 100.

Other items of information illustrated on FIG. 4 include a graphical representation of the gap G2, which runs from the line 146 to a line 140 that intersects the second sensor S2; and also a gap "G3" is depicted as running from the line 146 to a line 144 which, in a preferred mode of the present invention, represents a distance of 11 mm. This 11 mm gap G3 represents the amount of space within which the velocity of the sheet of print media is reduced or increased to its nominal and substantially constant velocity as it approaches the transfer nip 106, while dampening transient velocity effects. As the leading edge of the sheet of print media arrives at transfer nip 106, the velocity of the sheet will match the substantially predetermined constant velocity of the ITM belt 100.

Finally, FIG. 4 also illustrates a specific location that is representative of the signal R4, which will be discussed hereinbelow. The fourth roller 76 has a centerline, depicted at 142. As the trailing edge of the print media passes through this line 142, the signal R4 is generated. As mentioned above, the control velocity of the input drive rollers 70–76 must be matched as precisely as possible to the substantially predetermined constant velocity of the ITM transfer belt 100 so long as the sheet of print media is being contacted by both the transfer rollers 104 and 102, as well as the drive rollers 70–76. Once the trailing edge of a sheet of print media passes through the fourth drive roller 76, the velocity of the input drive rollers 70–76 can again be increased or decreased to handle the next physical piece of sheet media, as required by the control system.

Figure 5:
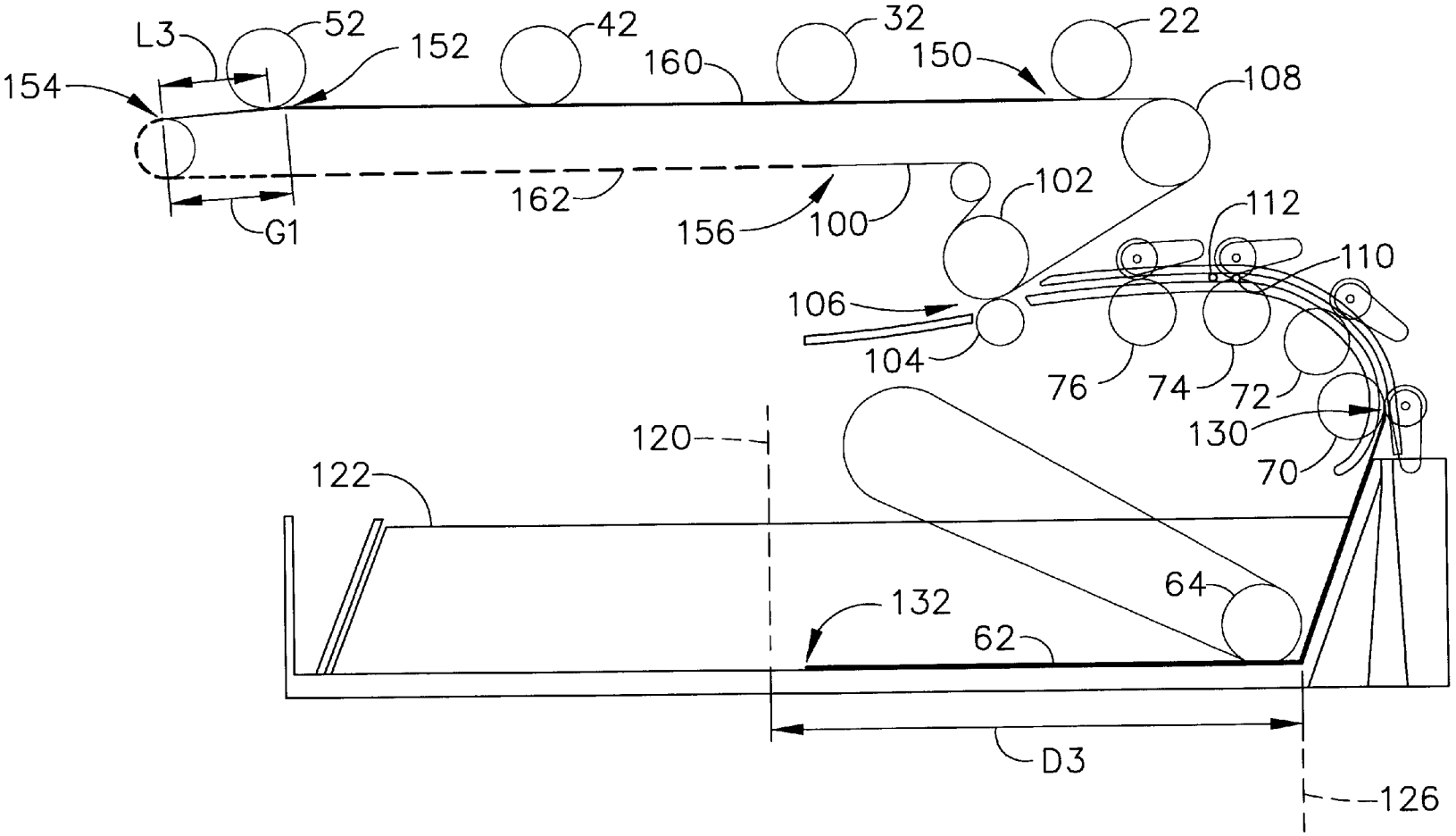
FIG. 5 is a cross-section elevational view of the printer of FIG. 2, showing the further progress of the ITM image on the ITM belt, and the sheet of print media through the drive rollers.

FIG. 5 illustrates the workings of the present invention at a time "T2" when both the sheet of print media and the image on the ITM belt 100 have proceeded a distance equal to the interpage gap G1. T2 represents the last possible moment in time when the printer controller must have information regarding the status of media in the sheet media tray 60 prior to commencing imaging for the second print. Therefore, the trailing edge of the first sheet of print media must have traveled past the sensing point for the media present sensor (i.e., at the line 120), or in other words, the remaining distance from the trailing edge of the sheet to the front of the sheet media tray must be less than the distance D3. The last sheet in the tray must have traveled at least to this point in order to inhibit imaging and thereby prevent an undesirable waste toner cleaning operation. The location of the media presence sensor is important, and a balance needs to be struck between its location for purposes of waste management and its location to accommodate the shortest media to be supported by the sheet feeder tray 60.

Figure 6:
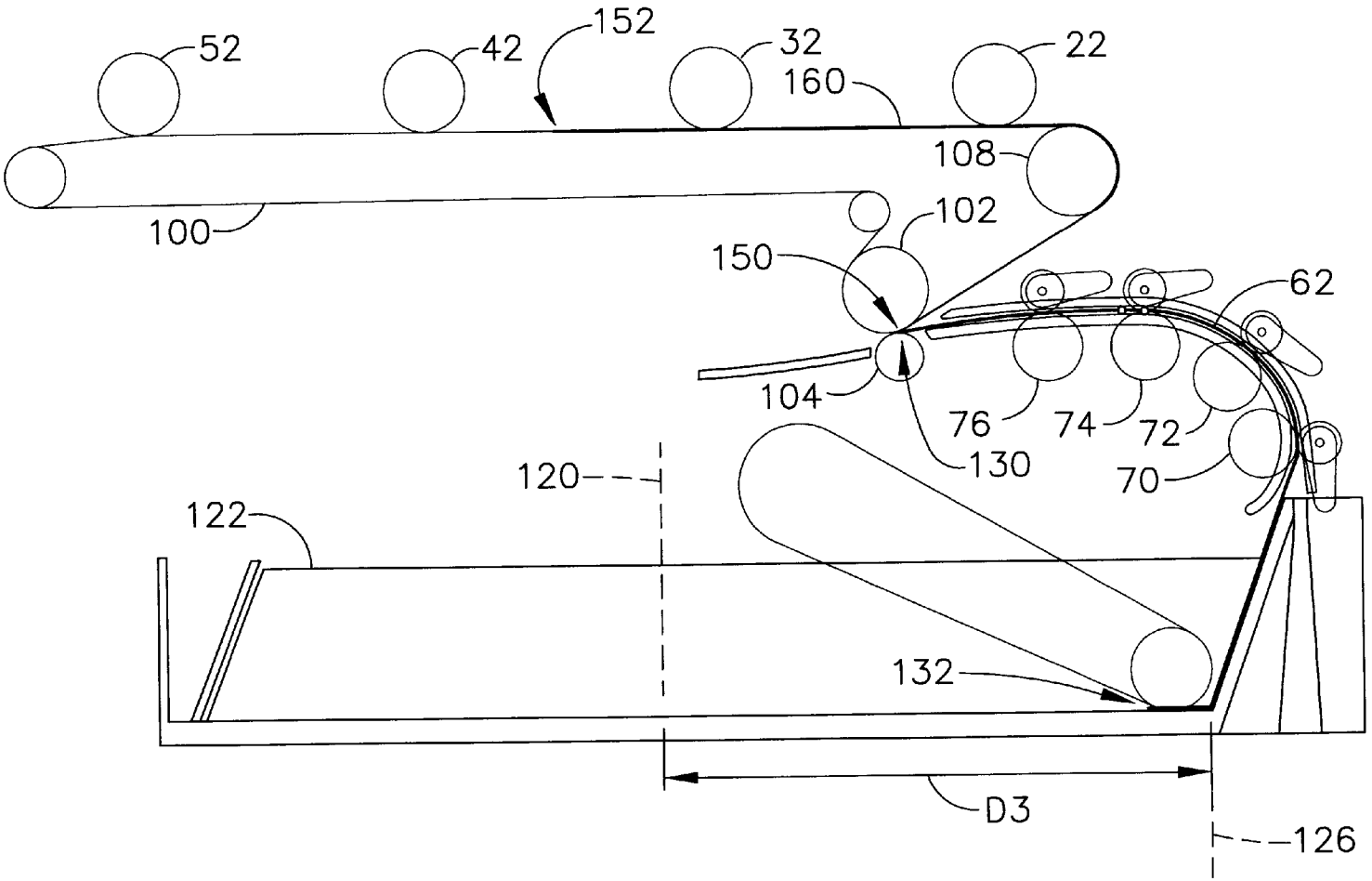
FIG. 6 is a cross-section elevational view of the printer of FIG. 2, showing the moment that the leading edge of the ITM image and the leading edge of the sheet media arrive simultaneously at the transfer nip.

FIG. 6 illustrates a time designated at "T3" at which the sheet of print media and the image on the ITM belt 100 converge at the transfer nip. This will occur after any positional corrections have been performed. Note that, for some media lengths, the trailing edge of the sheet of print media can still be partially within the sheet media tray 60 at time T3 when the transfer nip controls the velocity of the media as it is conveyed through the media registration mechanism. This can be seen at the point 132 on FIG. 6, which shows that the trailing edge of the sheet 62 of print media is still within the sheet media tray 60.

It will be understood that the precise numbers and locations of the input drive rollers (e.g., drive rollers 70–76), and the numbers and positions of paper sensors (e.g., sensors S1 and S2) can be significantly modified without departing from the principles of the present invention. It will be further understood that the number of laser (e.g., color) printheads and toner supply cartridges (e.g., process cartridges) and their locations with respect to one another and with respect to an ITM belt or some other type of transfer member can be significantly modified without departing from the principles of the present invention. It will still be further understood that other specific dimensions provided in the above examples of the preferred embodiment (such as dimension G3, and the interpage gap) can be significantly modified without departing from the principles of the present invention.

Figure 7:
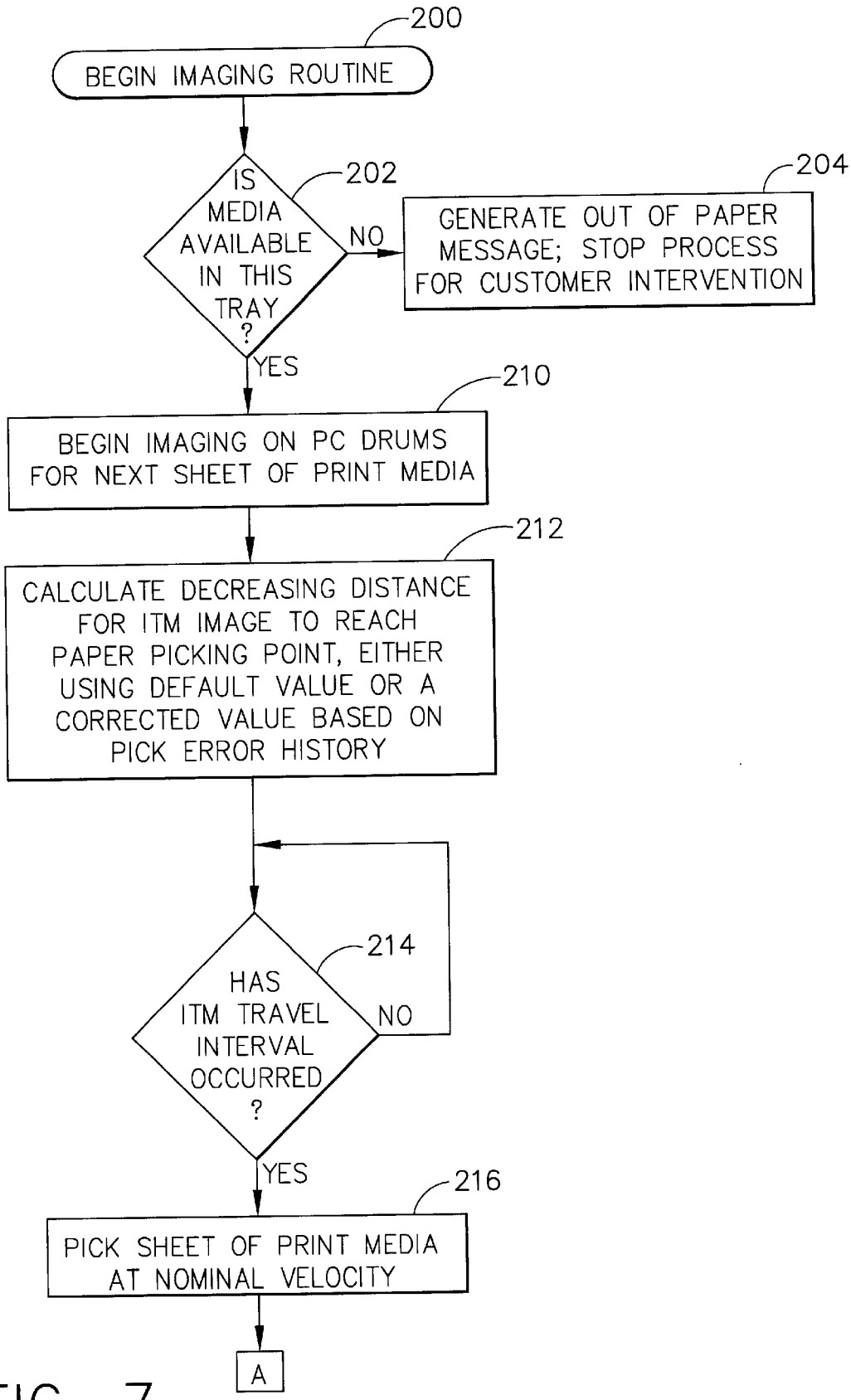
FIG. 7 is a flow chart showing some of the important logical operations for the imaging routine of the printer of FIG. 1, as according to the principles of the present invention.
Figure 8:
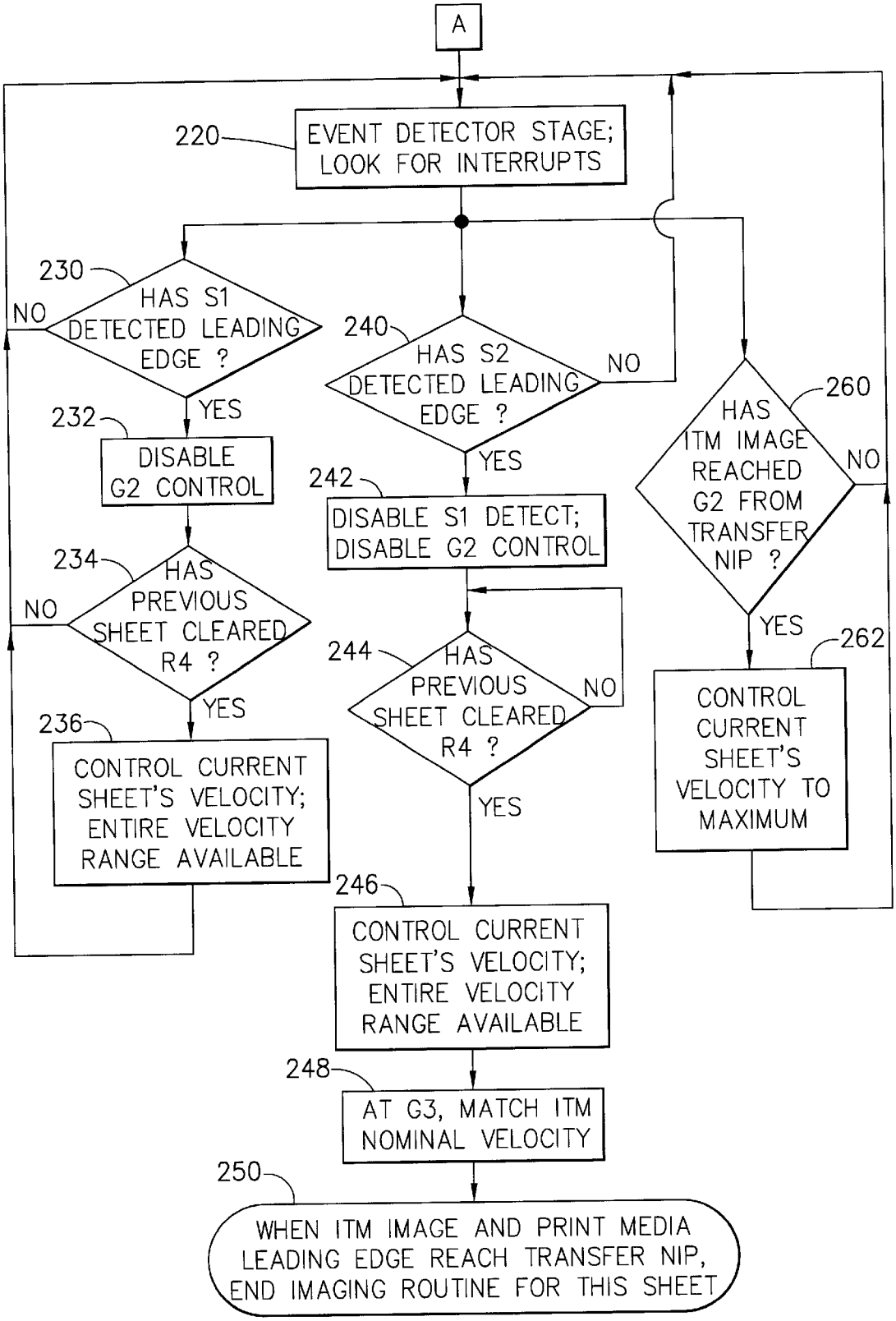
FIG. 8 is a second flow chart showing the event detector stage and later operational and logical functions that occur in the printer of FIG. 1, as according to the principles of the present invention.

FIGS. 7 and 8 are flow charts that describe many of the important logical decisions that are executed during the operations of the printer controller for the present invention. Starting at a step 200 on FIG. 7, the imaging routine starts. At a decision step 202, a sensor determines whether or not print media is available in the sheet feeder tray (e.g., the sensor located along the line 120 in feeder tray 60). If the answer is NO, a step 204 will generate an "out of paper" message, and the printing/imaging process is halted for customer intervention.

If the result in decision step 202 was YES, a step 210 begins imaging on the photoconductive drums for the next sheet of print media. As described above, there are multiple photoconductive drums (e.g., PC drums 22, 32, 42, and 52) that are positioned in tandem to simultaneously, if desired, place color toner on the ITM belt 100. In this description of the preferred embodiment, the step of "beginning imaging" represents an operation where the laser is turned on to strike the photoconductive drum for any one of the print engines.

A step 212 now calculates the decreasing distance for the ITM image to reach the paper picking point either using a default value or a corrected value based upon pick error history. Such pick error history occurrences could include phenomena such as a slippage error of paper rollers, paper picking slippages, a variable stack height of print media, gear backlash, or shingling of paper (as the print media). It will be understood that either time or position of the image on the ITM belt relative to the transfer nip's location could be used for calculating the decreasing "distance" in step 212. If time is used, then of course the velocity of the ITM belt must be known. If distance is used, the velocity of the ITM belt must still be known, as well as other important physical information, such as the number of pulses to be received at an encoder per unit distance of travel of the image upon the ITM belt 100.

A decision step 214 now determines whether or not the "ITM travel interval" has occurred. If the answer is NO, then the logic flow goes back to the beginning of this decision step in a "DO Loop" operation (with the understanding that the printer controller preferably is a multi-tasking device). If the answer is YES, then a step 216 will pick a sheet of print media from the sheet feeder tray 60, and begin moving that print media sheet at its nominal velocity. The nominal velocity will depend upon certain factors, including the nominal velocity of the ITM belt 100, which depends (as noted above) upon the print resolution used for this particular sheet.

The logic flow is now directed to a step 220 on FIG. 8. Step 220 is the "event detector stage" where interrupts are expected to be received from certain physical signals or logical decisions. The main physical signals that are expected consist of a transition in the output of the sensors S1 or S2. Once a transition has been made in one of these sensor signals, and if a positional error is detected, the sheet media drive motor will try to variably accelerate or decelerate the print media to incrementally calculated velocity operating points, and track the appropriate number of encoder pulses required to converge the leading edge of the media with the leading edge of the image on the ITM belt 100. Of course, the object is to remove leading edge registration error so that the physical sheet of print media arrives at the transfer nip 106 simultaneously with the arrival of the leading edge of the ITM image on the ITM belt 100.

On FIG. 8, decision steps 230, 240, or 260 could each occur first depending upon the circumstances of the movement of the sheet of print media. Consequently, a description of their operating logic must appear to be in parallel, even though a sequential logic device (e.g., a microprocessor or microcontroller) would typically be used to provide the physical electronics of the printer controller. Step 230 determines whether or not the sensor S1 has detected the leading edge of a sheet of print media. Similarly, decision step 240 determines whether or not the sensor S2 has detected the leading edge of a sheet of print media. Finally, decision step 260 determines if the ITM image has reached a distance G2 from the transfer nip 106. As noted above, any one of these conditions could occur first under certain circumstances.

If the result is NO for any of the decision steps 230, 240, or 260, then the logic flow is directed back to the event detector stage at step 220. In other words, the printer controller continues to look for interrupts based upon any of the physical or logical signals that are expected. If the result in decision step 230 is YES, then a step 232 disables the "G2 control" procedure, which essentially disables the decision step 260. If the result is YES at decision step 240, then a step 242 not only disables the G2 control procedure but also disables the "S1 detect" procedure, which essentially disables the decision step 230. In either situation (i.e., a YES result at decision steps 230 or 240), the next decision to be made is whether or not the previous sheet of print media has cleared the "R4 point" to prevent any print or feeding defects that might arise as a result of media being driven divergently by both the print media drive motors (i.e., the input drive rollers), and the ITM belt drive motor at any given time. In other words, the speed control routine for the next sheet of print media will not be initiated until after it has been determined by a prediction routine—using motor encoder feedback and the second sensor S2—when the trailing edge of any previous sheet of print media has exited the last of the drive rollers, at point R4.

At a predetermined process speed (i.e., the ITM belt velocity), the time delay required before the control routine can begin is a function of the interpage gap, the positional error of the second sheet, and the sensor placement with respect to the drive rolls, such that acceleration or deceleration of a second sheet of print media will not occur while the previous (or first) sheet is still under control by the drive rollers. Furthermore, once the leading edge of the sheet of print media undergoing positional correction arrives at sensor S2, an update of the sheet's position is made in the process control procedure to provide the best positional data before the printer controller continues its correction, in a semi-open loop fashion. Timing diagrams provided on FIGS. 9 and 10 graphically depict the control methodology for a typical situation where a "next sheet" of print media starts either "late" or "early."

Referring back to FIG. 8, the decision steps that determine if a previous sheet has cleared the R4 point are step 234 (after the S1 sensor has detected the leading edge) or step 244 (after the sensor S2 has detected a leading edge). If the result is NO at decision step 234, then the logic flow travels back to the event detector stage at step 220. In other words, no changes to the sheet's velocity are made at this time, and the next thing that should occur is a detection of the leading edge by the sensor S2. On the other hand, if the result at step 234 is YES, then a step 236 controls the current sheet's velocity, and the entire velocity range of the input rollers is available for a particular process speed of the ITM belt 100. The sheet of print media is now transported at its "position-correction velocity." The logic flow still travels back to the event detector stage 220, because (again) the next thing that should occur is a detection of the leading edge of the same sheet by the second sensor, S2.

If the result of decision step 244 is NO, then the logic flow merely returns to the beginning of the same decision step, more or less in a DO-loop (again, with the understanding that the printer controller preferably is a multi-tasking device). Eventually the previous sheet of print media will clear the R4 point, and when that occurs the result will become YES at decision step 244. The logic flow now is directed to a step 246 where the current sheet's velocity is controlled, and the entire velocity range is available (similar to the step 236). The sheet of print media is now transported at its "position-correction velocity." It must be remembered that, depending upon the exact placement of the sensors S1 and S2, a "narrow" print media may not be detected at all by the sensor S1, and therefore, the logic flow of the flow chart in FIG. 8 takes that possibility into account by being able to separately control the current sheet's velocity based only upon a detection by the second sensor, S2, of the leading edge of the current sheet of print media.

After the current sheet's velocity is controlled at step 246, this will continue until the leading edge of the current sheet of print media reaches the "G3 point." When this occurs, a step 248 will match the ITM belt nominal velocity by either slowing down or speeding up the current sheet of print media to match that velocity as precisely as possible. As discussed above, the distance G3 is a particular known and fixed distance from the transfer nip, and in the preferred embodiment illustrated in the above figures, this distance was given as 11 mm. Depending upon the precise printer sizes and motor mechanisms, as well as their control capabilities of these motor mechanisms, the distance G3 could be much longer or shorter, but of course it must be sufficiently long to enable the variable speed drive motors of the input rollers to correct (i.e., match) the current sheet's velocity within that G3 distance. This is very important, since the sheet of print media needs to make a smooth transition when its leading edge reaches the transfer nip and comes into contact with the ITM belt 100.

The final step performed in this logic flow is a step 250, which occurs when the ITM image and the print media leading edge simultaneously reach the transfer nip. This ends the imaging routine for this sheet, and of course the sheet will now be selectively coated with toner of one or more colors as the sheet runs through the transfer nip.

Since the process control for a particular printer configuration requires a finite media path length through which the positional error is to be eliminated, as described above, and then to subsequently return the print media to the appropriate process speed prior to entering the transfer nip (again as described above), it will be understood that, because of this finite length requirement there is a boundary on the maximum positional error that can be corrected within these dimensions. This boundary of maximum positional error that can be corrected is a function of the amount of path length allowed for making such positional corrections, and the allowable operating range of velocities of the variable speed media drive motor (that drives the input rollers). Any errors falling outside of these established boundaries will likely result in a failure to meet the top writing line specifications, or in the extreme would result in a media jam being declared by the printer.

The exact velocity to which the current sheet's movement is controlled (i.e., in steps 236 or 246) is based on calculated factors such as the position of the sheet of media versus the transfer nip as compared to the position on the ITM belt of the ITM image versus the transfer nip. The discussion of a preferred control methodology that is implemented for such error correction based upon feedback from the imaging system motors and the variable speed media drive motor is described in the previously incorporated pending U.S. application.

The third main possibility after the event detector stage at step 220 occurs is the decision step 260 that determines if the ITM image on the ITM belt 100 has reached the distance G2 from the transfer nip. If the answer is NO, then the logic flow is directed back to the event detector stage 220. However, if the answer is YES before the sheet of print media is detected by either sensor S1 or S2, then a situation has arisen such that the current sheet of print media is arriving "late." In this circumstance, a YES result from decision step 260 will cause the current sheet of print media to be driven at its maximum possible velocity by the control system, which occurs at a step 262. In this situation, the logic flow is still directed back to the event detector stage 220, because the sheet of print media should nevertheless be ultimately detected by the sensors S1 and S2, and when that occurs, the velocity can be controlled by either step 236 or step 246, as required, to modify the velocity somewhat, or potentially to continue to control the current sheet's velocity at its maximum possible rate given the operating parameters and process speed of the ITM belt 100.

It will be understood that the decision as to whether or not the sheet of print media is "late" can be taken based upon either a time interval, or a distance interval or "movement interval." In other words, a particular printer design may be more well suited to make this type of determination based upon a passage of time after a particular event has occurred (such as after a paper picking operation), such as the beginning of imaging of the first photoconductive drum on the ITM belt 100. In the preferred embodiment, distance is instead used, although a variation on that theme would be to detect motor pulses or encoder pulses to determine a certain predetermined distance, if that methodology would be beneficial in certain printer designs.

Figure 9:
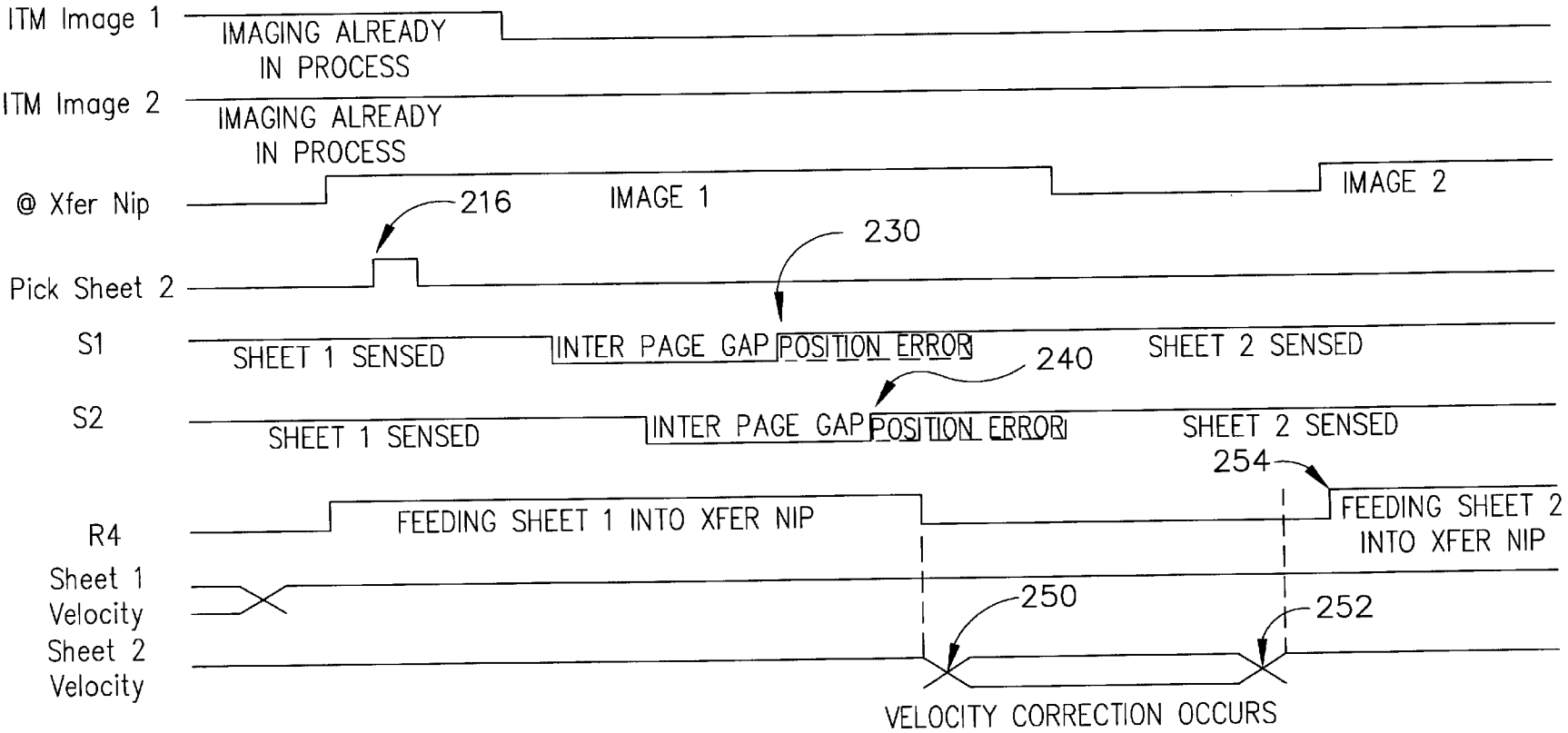
FIG. 9 is a timing diagram showing some of the important signals of the printer of FIG. 1 that occur when a second sheet of print media has been picked "early."
Figure 10:
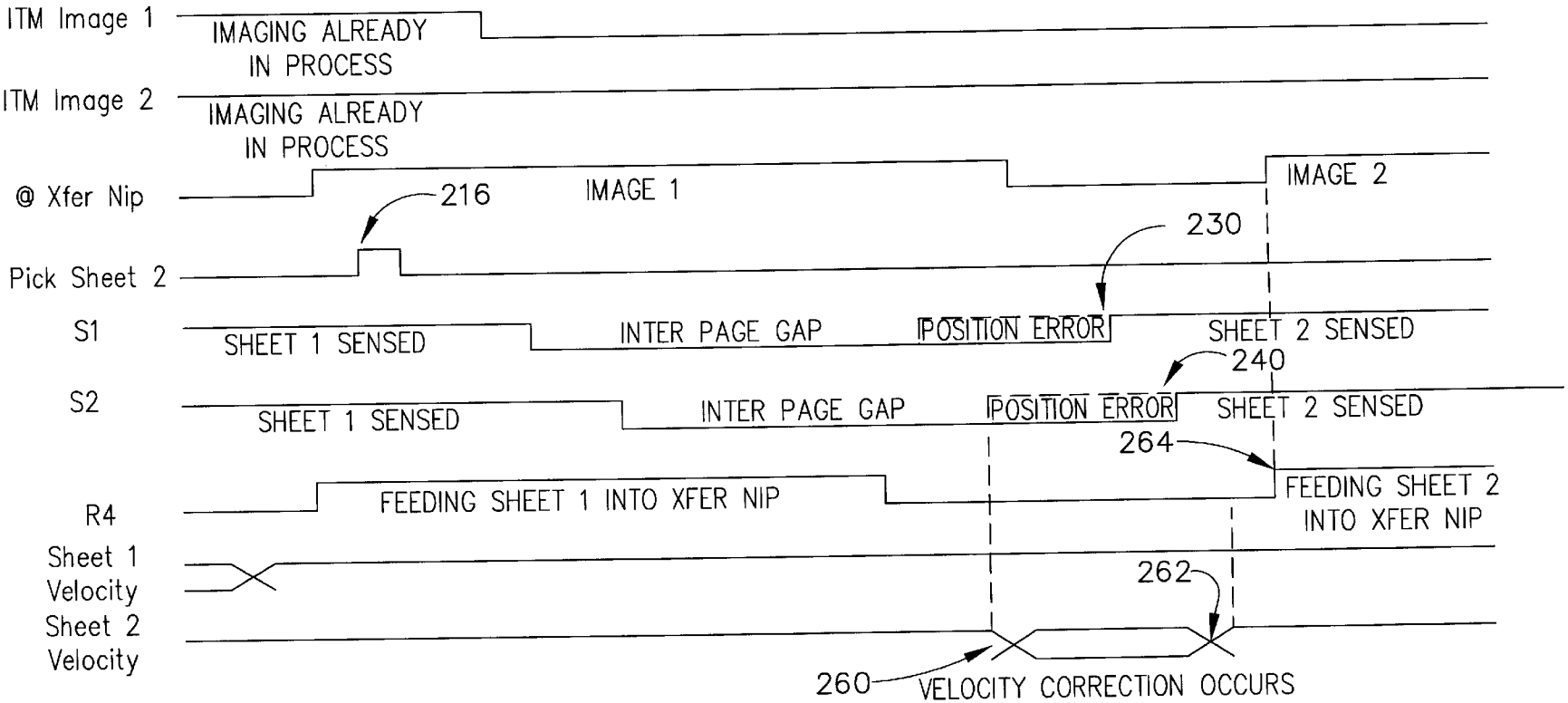
FIG. 10 is a timing diagram showing some of the important signals of the printer of FIG. 1 that occur when a second sheet of print media has been picked "late."

FIGS. 9 and 10 are timing diagrams describing events when sheets that do not arrive at the sensors S1 and S2 at their nominal timings. For example, FIG. 9 describes a situation where the second sheet of print media arrives somewhat "early" as compared to its nominal expected timing. When this occurs, naturally the printer controller will desire to slow down that second sheet so that it arrives at the transfer nip at the appropriate time.

On FIG. 9, the top graph represents the fact that imaging is already in process for the first ITM image on the ITM belt 100. The second graph line from the top represents the fact that imaging is already in process for a second image on the ITM belt. This is the physical situation illustrated in FIGS. 4 and 5, described hereinabove. The third graph from the top represents whether or not the ITM belt image for a sheet is currently located at the transfer nip 106, and as can be seen, the first image occurs for a first time interval, then there is no image at the transfer nip for a second time interval, after which the second image arrives (at the beginning of a third time interval).

The fourth graph from the top represents the timing of picking the second sheet of print media. This occurs at a time mark designated by the reference numeral 216. The next two graphs represent the logic states of the sensors S1 and S2, which will be described in greater detail below. The next graph represents the R4 signal, which corresponds to whether or not a sheet of print media is passing through the nip of the final drive roller (the drive roller 76 on FIG. 4). The final two graphs individually represent the sheet velocity of the first physical print media sheet and the second physical print media sheet.

In the second graph from the bottom on FIG. 9, the sheet velocity for the first sheet is shown as being variable at the left-hand portion of the timing diagram, after which its velocity becomes constant throughout the rest of this timing diagram. This represents the fact that the first sheet is running through the transfer nip and beyond to receive the toner of the first image on the ITM belt 100. In reality, once the leading edge of the first sheet reaches the transfer nip 106, it must maintain that constant velocity throughout the rest of its travel while in contact with the ITM belt 100. The bottom graph of FIG. 9 represents the velocity of the second sheet, which has its velocity variably controlled at a later point in the process, which is represented by the reference numeral 250.

The two graphs for the sensors S1 and S2 are each shown in their Logic 1 state when a sheet is present at the sensor, for either sensor S1 or S2. Therefore, on FIG. 9 the sensor signal S1 begins by being at Logic 1, since the first sheet has been detected. This also is true for the signal S2, which means that the sheet is being simultaneously detected by both sensors. After a time period, the signal S1 transitions to its Logic 0 state, which is described on FIG. 9 as having arrived at the interpage gap. Somewhat later on the timing diagram the logic state of signal S2 also transitions to Logic 0, which is a further indication of the interpage gap having been arrived at.

At the location represented by the reference numeral 230, the second sheet arrives at sensor S1, which makes a transition at this point 230. This is earlier than expected, because the sheet would nominally have arrived later, which is represented by the dashed line and the statement of "positional error" on FIG. 9. No velocity change occurs at this time because the signal R4 still shows its Logic 1 state occurring at this moment, which means that the first sheet is still being held by the final input roller nip at the location designated as R4.

The reference numeral 240 now shows that the signal S2 makes a transition, which again is "early," since it would not have nominally occurred until later, as shown by the dashed line and the words "positional error." Again, the velocity of the second sheet is not changed because the first sheet is still being held through the final nip of the input drive rollers, at the location R4. Once R4 makes a transition from Logic 1 to Logic 0, velocity correction of the second sheet can now occur, as indicated by the reference numeral 250. The second sheet will now be slowed down substantially so that it will arrive at the transfer nip 106 at the correct time to correspond to the arrival of the ITM image on ITM belt 100. The velocity control runs at its slower velocity up to a certain time, designated at 252 on FIG. 9, after which its actual velocity is controlled to correspond to the nominal process velocity of the ITM belt. At the appropriate time, the signal R4 makes a positive transition to its Logic 1 state, which means that the second sheet is now feeding through R4's position and then into the transfer nip 106. This occurs at the signal 254, and imaging at the transfer nip for the second sheet also begins to occur.

With respect to FIG. 10, essentially the same information is depicted, although the second sheet is illustrated as being "late" as compared to its normal or nominal expected timing.

On the first half (i.e., the left half) of the timing diagram of FIG. 10, the information is essentially identical to that of FIG. 9. The major difference is the fact that the signal S1 does not occur early, and in fact occurs late. The situation is likewise true for the signal S2. On FIG. 10, the printer controller determines—at the moment designated by the reference numeral 260—that velocity correction needs to occur now, since the sheet is arriving so "late." Therefore, the velocity correction is shown as occurring between the reference numerals 260 and 262. The amount of position error is depicted at the graph for S1 between the dashed line and the reference numeral 230, as indicated by the term "position error." Similarly, the amount of position error on the graph for the signal S2 is illustrated as being between the dashed line and the reference numeral 240, and by the words "position error."

The velocity correction must end at the timing mark 262, to allow the sheet of print media to slow down to a velocity that matches the ITM belt's process velocity by the time the second sheet arrives at the transfer nip 106. The signal R4 does not interfere with the velocity correction at all in this illustration of a "late" sheet on FIG. 10, since the first sheet had well exited the position at R4 before any velocity correction was determined as being required at the time mark 260. At the time mark 262 with regard to the signal R4, this denotes the fact that the second sheet passes the final input roller nip, and imaging on the ITM belt begins at this time mark 264.

It will be understood that the exact signals used in the graphical depictions for these timing diagrams of FIGS. 9 and 10 could be drastically changed without departing from the principles of the present invention. Certainly different locations for sensor placement would significantly change the timing diagrams, and furthermore different drive roller placements for the input drive rollers could also significantly affect the timing diagrams.

Figure 11:
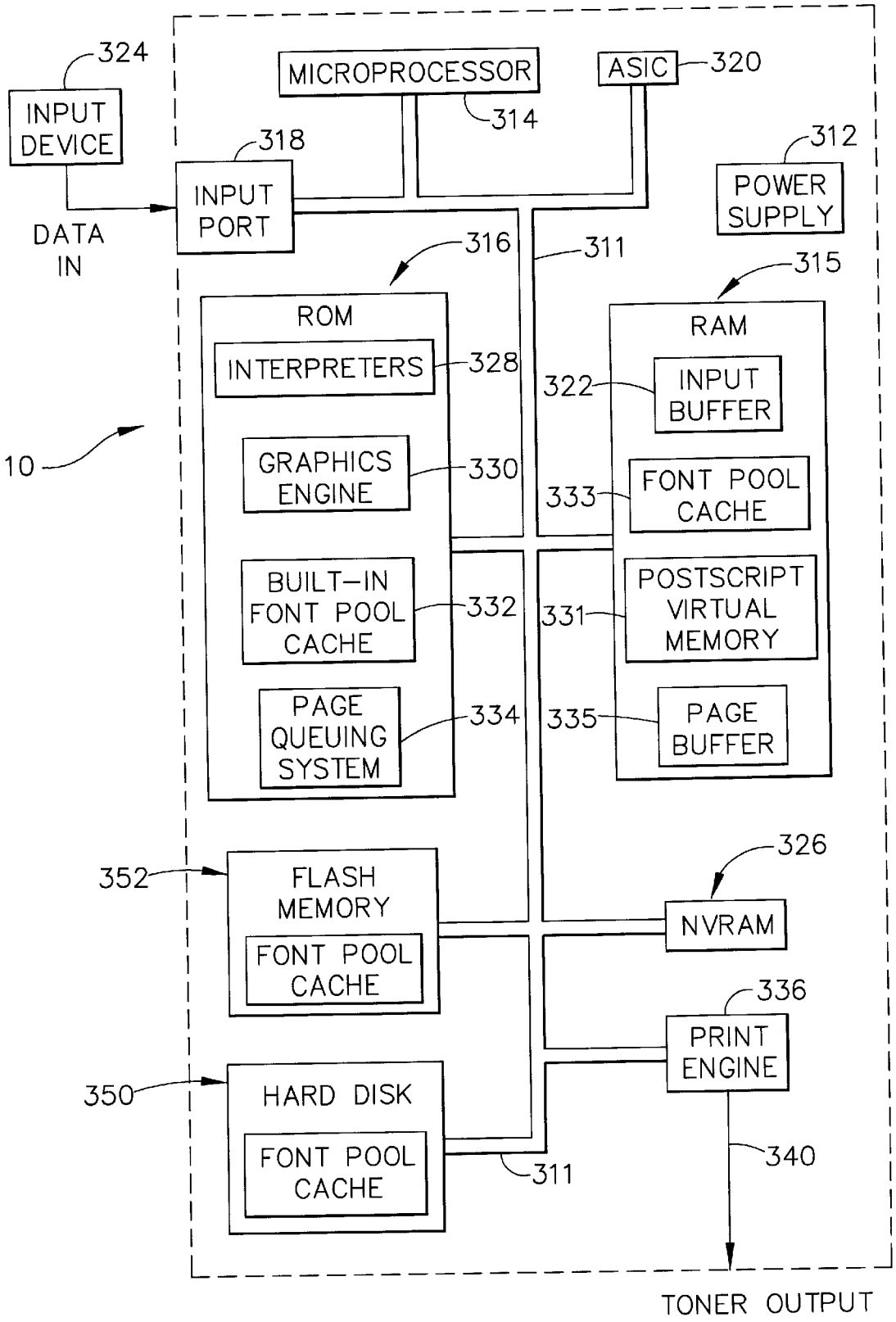
FIG. 11 is a block diagram of some of the major electronic components of a printer, as according to the present invention.

FIG. 11 illustrates a hardware block diagram of some of the major electronic components of laser printer 10, according to the present invention. Laser printer 10 will preferably contain certain relatively standard components, such as a DC power supply 312 which may have multiple outputs of different voltage levels, a microprocessor 314 having address lines, data lines, and control and/or interrupt lines, Read Only Memory (ROM) 316, and Random Access Memory (RAM) 315, which are divided by software operations into several portions for performing several different functions.

Laser printer 10 also contains at least one input port, or in many cases several types of input ports, as designated by the reference numeral 318. Each of these ports would be connected to a corresponding input buffer, generally designated by the reference numeral 322 on FIG. 11. Each port 318 would typically be connected to an output port of either a personal computer (PC) or a workstation (WS) (designated on FIG. 11 as an "input device" 324) that would contain a software program such as a word processor or a graphics package or computer aided drawing package, or to a network that could be accessed by such a PC or WS. Laser printer 10 preferably will also contain an Application Specific Integrated Circuit (ASIC) 320, which typically contains a large number of programmable logic circuits.

Once text or graphical data has been received by input buffer 322, it is commonly communicated to one or more interpreters designated by the reference numeral 328. A common interpreter is PostScript™, which is an industry standard used by many laser printers. To speed up the process of rasterization, a font pool and typically also a font cache are stored in memory within most laser printers, and these font memories are designated by the reference numeral 332, 333, 350 and 352 on FIG. 1.

Once the data has been rasterized, it is directed by a page queuing system 334 into a page buffer, which is a portion of RAM designated by the reference numeral 335. The data within the page buffer 335 is communicated in real time to a print engine designated by the reference numeral 336. Print engine 336 includes a laser light source within its printhead (not shown on FIG. 11), and its output 340 is the physical application of toner onto a piece of paper, or in the present invention, onto the ITM belt 100. Print engine 336 is representative of one of the four color laser printheads at 20, 30, 40, and 50, as viewed on FIG. 1.

It will be understood that the address, data, and control lines are typically grouped in buses, which are electrically conductive pathways that are physically communicated in parallel (sometimes also multiplexed) around the various electronic components within laser printer 10. For example, the address and data buses are typically sent to all ROM and RAM integrated circuits, and the control lines or interrupt lines are typically directed to all input or output integrated circuits that act as buffers. For ease of illustrating the present invention, the various buses used within printer 10 are grouped on FIG. 1 into a single bus pathway, designated by the reference numeral 311.

A portion of the RAM 315 is typically allocated for virtual memory for at least one interpreter, and on FIG. 11 a PostScript virtual memory is depicted at the reference numeral 331. In addition, particularly important information that is to be retained in printer 10 while unpowered can be stored in a quickly accessible non-volatile memory location called "NVRAM" (typically an EEPROM integrated circuit chip) which is designated by the reference numeral 326.

The "printer controller" referred to hereinabove can comprise the main system microprocessor 314, or alternatively can comprise a microcontroller or microprocessor that is embedded in the ASIC 320. A further possibility is to use a combination of microprocessors or microcontrollers that are provided with each laser print engine of printer 10, although this would likely prove more difficult to program from a software standpoint, since the computer code for at least one print engine would need to contain functions that have nothing to do with the print engine itself. Moreover, print engine controllers typically incorporate microprocessors or microcontrollers having less processing power than the main laser printer's microprocessor (e.g., microprocessor 314), and therefore, additional programmed functions are typically not welcome by designers of print engines.

It will be understood that the logical operations described in relation to the flow charts of FIGS. 7 and 8 can be implemented using sequential logic, such as by using microprocessor technology or using a logic state machine; it even could be implemented using parallel logic. The preferred embodiment uses a microprocessor (e.g., microprocessor 314) to execute software instructions that are stored in memory cells within ROM 316, or potentially within ASIC 320. Of course, other circuitry could be used to implement these logical operations depicted in FIG. 11 without departing from the principles of the present invention.

It will be further understood that the precise logical operations depicted in the flow charts of FIGS. 7 and 8, and discussed hereinabove, could be modified to perform similar, although not exact, functions without departing from the principles of the present invention. The exact nature of some of the decision steps and other commands in these flow charts are directed toward specific models of printer systems (those using Lexmark printers, for example) and certainly similar, but somewhat different, steps would be taken for use with other types of printing systems in many instances, although the overall inventive results would be the same.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. A method for controlling positional error in an image forming system, said method comprising:

(a) providing an image forming apparatus having a memory circuit for storage of data, and a processing circuit for controlling at least one physical device;

(b) providing at least one print engine, an intermediate transfer member, and an input print media pathway, wherein said intermediate transfer member and said input print media pathway physically converge at a transfer nip;

(c) applying an image onto said intermediate transfer member by way of said at least one print engine, while controlling said intermediate transfer member at a substantially predetermined velocity, wherein the substantially predetermined velocity of said intermediate transfer member is dependent upon a print resolution of said image forming system; and (d) controlling a variable velocity of a sheet of print media as that sheet travels through said input print media pathway, without halting movement of said sheet at any time after said sheet has begun movement, so as to cause a leading edge of said sheet to arrive at said transfer nip at substantially the same moment as a leading edge of said image traveling on said intermediate transfer member, thereby substantially eliminating registration error.

2. The method as recited in claim 1, wherein said at least one print engine comprises a plurality of color print engines; and said intermediate transfer member comprises a belt that accepts charged toner and applies the toner to print media at the transfer nip.

3. The method as recited in claim 1, wherein the variable velocity of said sheet is controlled by said image forming apparatus to either increase or decrease velocity from an initial velocity of said sheet, after the sheet is picked from a print media source.

4. The method as recited in claim 3, wherein the variable velocity of said sheet is controlled by said image forming apparatus to a position-correction velocity: (1) after the leading edge of said sheet is detected by at least one sensor, or (2) after it has been determined that the leading edge of said sheet is "late" when a predetermined distance has occurred, or when a predetermined time interval or a predetermined movement interval has occurred after a sheet picking operation.

5. The method as recited in claim 4, wherein the variable velocity of said sheet is controlled by said image forming apparatus to either increase or decrease velocity from its position-correction velocity to a nominal velocity that closely matches the substantially predetermined velocity of said intermediate transfer member, once the leading edge of said sheet arrives at a predetermined location occurring before said sheet arrives at the transfer nip.

6. The method as recited in claim 4, wherein the variable velocity of said sheet is controlled by said image forming apparatus to not change the velocity of a second sheet of print media that is traveling through said input print media pathway while, at the same moment, said first sheet of print media continues to be driven by both an input drive roller and by rolls forming said transfer nip.

7. The method as recited in claim 1, further comprising: prior to imaging at said at least one print engine and prior to initiating a picking operation at an input print media source, determining whether at least one sheet of print media currently exists within said input print media source, and if not, preventing imaging to reduce toner wastage.

8. An image forming apparatus, comprising:

a memory circuit for storage of data, and a processing circuit for controlling at least one physical device, at least one print engine, an intermediate transfer member, and an input print media pathway, wherein said intermediate transfer member and said input print media pathway physically converge at a transfer nip;

wherein said processing circuit is configured to: use said at least one print engine to apply an image onto said intermediate transfer member, while controlling said intermediate transfer member at a substantially predetermined velocity, wherein the substantially predetermined velocity of said intermediate transfer member is dependent upon a print resolution of said image forming system; and to control a variable velocity of a sheet of print media as that sheet travels through said input print media pathway, without halting movement of said sheet at any time after said sheet has begun movement, so as to cause a leading edge of said sheet to arrive at said transfer nip at substantially the same moment as a leading edge of said image traveling on said intermediate transfer member, thereby substantially eliminating registration error.

9. The image forming apparatus as recited in claim 8, wherein said at least one print engine comprises a plurality of color print engines; and said intermediate transfer member comprises a belt that accepts charged toner and applies the toner to print media at the transfer nip.

10. The image forming apparatus as recited in claim 8, wherein the substantially predetermined velocity of said intermediate transfer member is controlled by a variable-speed belt motor drive.

11. The image forming apparatus as recited in claim 8, wherein the variable velocity of said sheet is controlled by a variable-speed input motor drive that physically drives a plurality of input drive rollers to either increase or decrease velocity from an initial velocity of said sheet, after the sheet is picked from a print media source.

12. The image forming apparatus as recited in claim 11, wherein the variable velocity of said sheet is controlled by said variable-speed input motor drive to a position-correction velocity: (1) after the leading edge of said sheet is detected by at least one sensor, or (2) after it has been determined that the leading edge of said sheet is "late" when a predetermined distance has occurred, or when a predetermined time interval or a predetermined movement interval has occurred after a sheet picking operation.

13. The image forming apparatus as recited in claim 12, wherein the variable velocity of said sheet is controlled by said variable-speed input motor drive to either increase or decrease velocity from its position-correction velocity to a nominal velocity that closely matches the substantially predetermined velocity of said intermediate transfer member, once the leading edge of said sheet arrives at a predetermined location occurring before said sheet arrives at the transfer nip.

14. The image forming apparatus as recited in claim 12, wherein the variable velocity of said sheet is controlled by said variable-speed input motor drive to not change the velocity of a second sheet of print media that is traveling through said input print media pathway while, at the same moment, said first sheet of print media continues to be driven by both an input drive roller and by said intermediate transfer member.

* * * * *